US006365019B1

(12) United States Patent
Herrmann et al.

(10) Patent No.: US 6,365,019 B1
(45) Date of Patent: Apr. 2, 2002

(54) UNIVERSAL FUEL BASKET FOR USE WITH AN IMPROVED OXIDE REDUCTION VESSEL AND ELECTROREFINER VESSEL

(75) Inventors: Steven D. Herrmann; Robert D. Mariani, both of Idaho Falls, ID (US)

(73) Assignee: The United States of America as represented by the Department of Energy, Washington, DC (US)

( * ) Notice: Subject to any disclaimer, the term of this patent is extended or adjusted under 35 U.S.C. 154(b) by 0 days.

(21) Appl. No.: 09/645,608

(22) Filed: Aug. 25, 2000

(51) Int. Cl.[7] ..... C25C 7/00

(52) U.S. Cl. ..... 204/272; 204/212; 204/243.1; 204/227; 204/287; 205/47

(58) Field of Search ..... 204/287, 272, 204/284, 212, 243.1, 227; 205/46, 47

(56) References Cited

U.S. PATENT DOCUMENTS 4,242,192 A * 12/1980 Dunning, Jr. et al. ..... 204/213
5,650,053 A * 7/1997 Gay et al. ..... 204/212

* cited by examiner

*Primary Examiner*—Kathryn Gorgos
*Assistant Examiner*—Thomas H Parsons
(74) *Attorney, Agent, or Firm*—Mark LaMarre; Mark P. Dvorscak; Virginia B. Caress

(57) ABSTRACT

A basket, for use in the reduction of $UO_2$ to uranium metal and in the electrorefining of uranium metal, having a continuous annulus between inner and outer perforated cylindrical walls, with a screen adjacent to each wall. A substantially solid bottom and top plate enclose the continuous annulus defining a fuel bed. A plurality of scrapers are mounted adjacent to the outer wall extending longitudinally thereof, and there is a mechanism enabling the basket to be transported remotely.

17 Claims, 4 Drawing Sheets

Universal Basket Configured in a Mark V Electrorefiner Anode–Cathode–Module

Pilot–Scale Oxide Reduction Equipment

Universal Basket Configured for Oxide Reduction Operations

Universal Basket Configured in a Mark V Electrorefiner Anode–Cathode–Module

Universal Basket Configured in a Mark V Electrorefiner Anode–Cathode–Module

UNIVERSAL FUEL BASKET FOR USE WITH AN IMPROVED OXIDE REDUCTION VESSEL AND ELECTROREFINER VESSEL

STATEMENT REGARDING FEDERALLY SPONSORED RESEARCH OR DEVELOPMENT

The United States Government has rights in this invention pursuant to Contract No.W-31-109-ENG-38 between the U.S. Department of Energy (DOE) and The University of Chicago representing Argonne National Laboratory.

BACKGROUND OF THE INVENTION

Argonne National Laboratory (ANL) has developed and is presently demonstrating the electrometallurgical treatment of sodium-bonded metal fuel from Experimental Breeder Reactor II, resulting in an uranium product and two stable waste forms, i.e. ceramic and metallic. Engineering efforts are underway to develop pilot-scale equipment which preconditions irradiated oxide fuel via pyrochemical processing and subsequently allows for electrometallurgical treatment of such non-metallic fuels into standard products and waste forms.

An oxide reduction process preconditions irradiated oxide fuel such that uranium and transuranic (TRU) constituents are chemically reduced into metallic form via a molten Li/LiCI-based reduction system. In this form, the spent fuel is further treated in an electrorefiner and waste handling equipment, thereby reclaiming uranium, and placing TRU elements and fission products into stable forms suitable for disposal in a long-term repository. Development of the Li/LiCI-based oxide reduction process has proceeded at lab scale (nominally 50 grams of heavy metal (HM) and engineering scales (nominally 10-kg of HM) for unirradiated oxide fuel.

The integrated oxide reduction and electrorefining process steps include: 1) preparing the spent fuel for treatment; 2) chemically reducing uranium and TRU constituents; 3) electrorefining the reduced fuel; 4) conditioning the reclaimed uranium and fission product containing waste forms; and 5) regenerating the lithium reductant. Preparation of spent oxide fuel involves chopping fuel elements and loading fuel and cladding into a permeable basket which, heretofore, has been of two different designs, one for the reduction and another for the electrorefining. This invention involves designing a basket which is universal to oxide reduction and electrorefining processes. In the oxide reduction process, lithium and lithium chloride are maintained molten at 650° C. When a fuel-loaded basket is placed into this system, the lithium reduces oxides of uranium and TRU constituents into metallic form via the following reaction.

$$MO_2+4Li=>2Li_2O+M$$

(where M=uranium and TRU elements)

The lithium chloride dissolves the resultant lithium oxide from the fuel matrix. Previously, the reduced fuel was physically transferred to a different process container and placed in the electrorefiner, a procedure that is difficult and time consuming. This invention obviates the need for transfer by providing a universal basket design which may be compatible in both the reducing and electrorefining operations.

The new basket containing reduced fuel from the reduction process is placed directly into an electrorefiner, where the uranium is electrochemically dissolved into and transported across a molten lithium/potassium chloride eutectic salt at 500° C. Upon completion of the electrorefining process, the uranium product is cast into ingots. The cladding hulls and fission products remaining in the anode basket are processed into a metal waste form. Once fission product or contaminant limits are reached, the TRU and fission product containing salt is processed into a ceramic waste form. An electrowinning process recovers metallic lithium from the salt-soluble lithium oxide and discards the oxygen.

BRIEF SUMMARY OF THE INVENTION

It is an object of the present invention to provide a universal basket useful in both the oxide reduction operation and the electrorefiner part of the anode-cathode module so that material containing uranium values may be transferred from the oxide reduction operation to the electrorefiner by transporting the basket between the two systems.

Another object of the present invention is to provide a basket for use in the reduction of uranium dioxide to uranium metal and in the electrorefining of uranium metal in which the basket includes an inner and outer perforated cylindrical wall defining a continuous annulus therebetween, a screen adjacent to each perforated cylindrical wall, a substantially solid bottom and top plate enclosing the continuous annulus formed by the inner and outer perforated cylindrical walls defining a fuel bed, a plurality of scrapers mounted adjacent to the outer perforated cylindrical wall extending longitudinally thereof, and mechanism enabling the basket to be transported remotely.

Yet another object of the present invention is to provide a universal basket as defined and further including a crucible surrounding the basket, a source of lithium metal substantially surrounding the basket inside the crucible, a source of molten salt containing LiCl substantially saturated with lithium metal in contact with the basket and the source of lithium metal, and impeller mechanism for forcing the molten salt substantially saturated with lithium metal through the inner cylindrical wall in contact with $UO_2$ in the fuel bed to cause $UO_2$ to be reduced to uranium metal.

A final object of the present invention is to provide an anode-cathode module for the electrorefining of uranium, comprising an anode formed by a continuous annular fuel bed defined by inner and outer perforated cylindrical walls having substantially solid top and bottom plates for holding uranium values, a plurality of scrapers circumferentally spaced around the outer perforated cylindrical wall extending longitudinally thereof, a cylindrical cathode spaced from and surrounding the anode defining an annular electrolyte space, the anode and cathode being electrically insulated from each other, and mechanism for causing electrolyte to flow upwardly through the inner perforated cylindrical wall and the annular fuel bed with the uranium values therein rotating said anode with respect to said cathode, the electrolyte flowing into the annular electrolyte space to establish electrotransport of uranium values between the anode and cathode resulting in the precipitation of uranium values on the cylindrical cathode upon establishment of an electrical potential between the anode and cathode.

The invention consists of certain novel features in a combination of parts hereinafter fully described, illustrated in the accompanying drawings, and particularly pointed out in the appended claims, it being understood that various changes in the detail may be made without departing from the spirit, or sacrificing any of the advantages of the present invention.

DETAILED DESCRIPTION OF THE INVENTION

Figure 1:
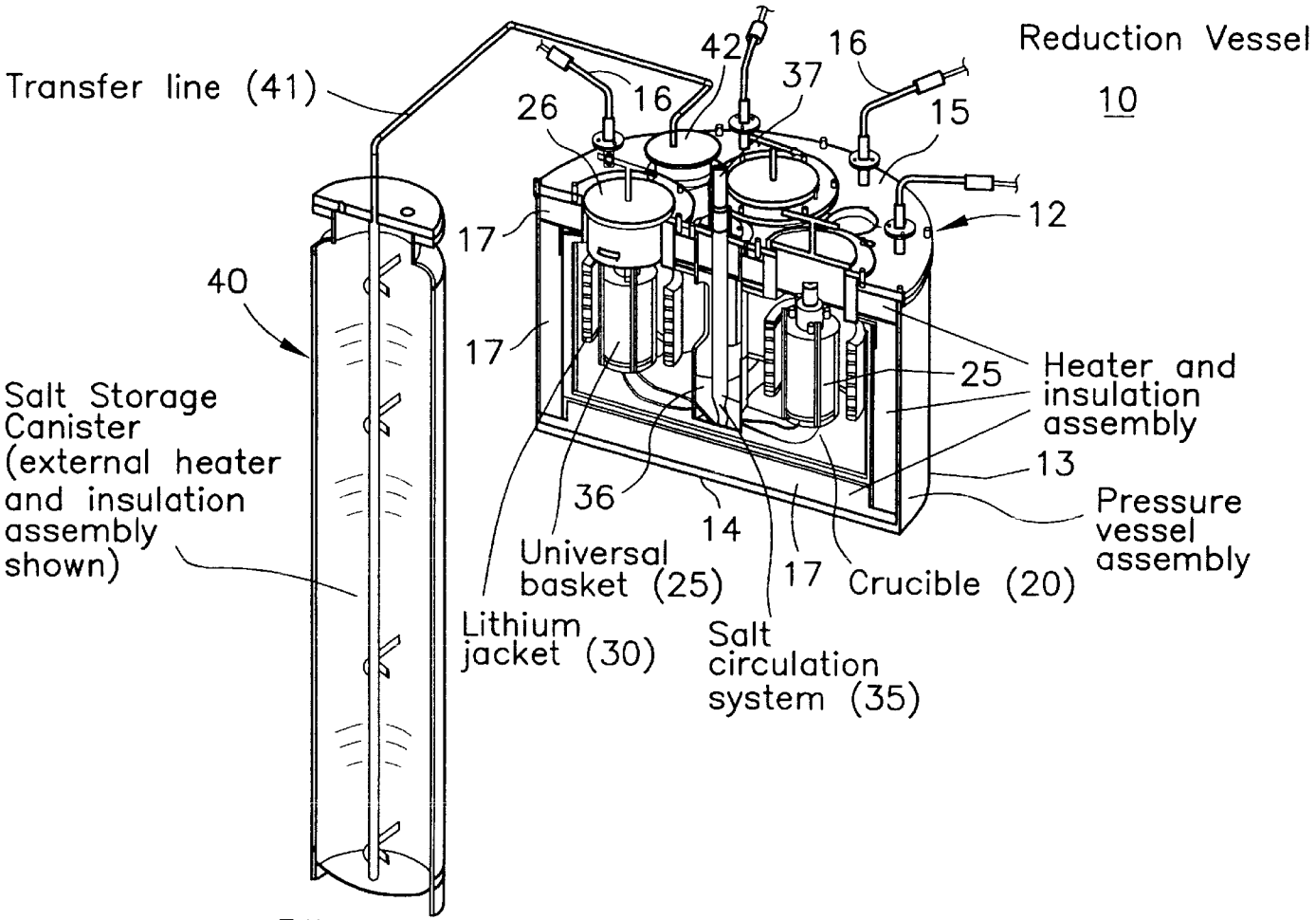
FIG. 1 is a schematic representation of pilot scale oxide reduction equipment.

Referring now to the drawings, there is disclosed particularly in reference to FIG. 1 an oxide reduction system 10 which includes an oxide reduction vessel 12 having a cylindrical pressure vessel 13 sealed by a bottom wall 14 and a top wall 15. Insulation 17 surrounds heaters (not shown), the leads to which are represented by connectors 16, and crucible 20 at both the cylindrical wall, the bottom and the top. A crucible 20, generally cylindrical in shape, is interior of the insulation 17.

A plurality of universal baskets 25 are provided in the oxide reduction system. Preferably, four universal baskets 25 are provided in a circular configuration each located at approximately 90° circumferentially from each other. Although the universal basket 25 will be hereinafter more fully described, each basket is provided with a closure assembly 26 in the reduction vessel 12.

Surrounding each of the universal baskets 25 is a lithium jacket 30 which provides a source of lithium metal. Centrally located in the oxide reduction system 10 and particularly in reduction vessel 12 is a salt circulation system 35 which includes among other things an impeller blade 36 positioned near the bottom of the crucible 20 and a impeller shaft 37 extending axially of the reduction vessel 12 outwardly through the top wall 15 thereof to be connected with a motor mechanism (not shown) for rotating the impeller blade 36. Exterior of the reduction vessel 12 is a salt storage container 40 for storing a source of salt, preferably containing lithium chloride. Other metal chlorides may be useful in the salt. The salt storage container 40 is provided with a transfer line 41 which connects the storage container 40 to the reduction vessel 12 through a fitting 42 in the top wall 15 of the reduction vessel 12.

Figure 2:
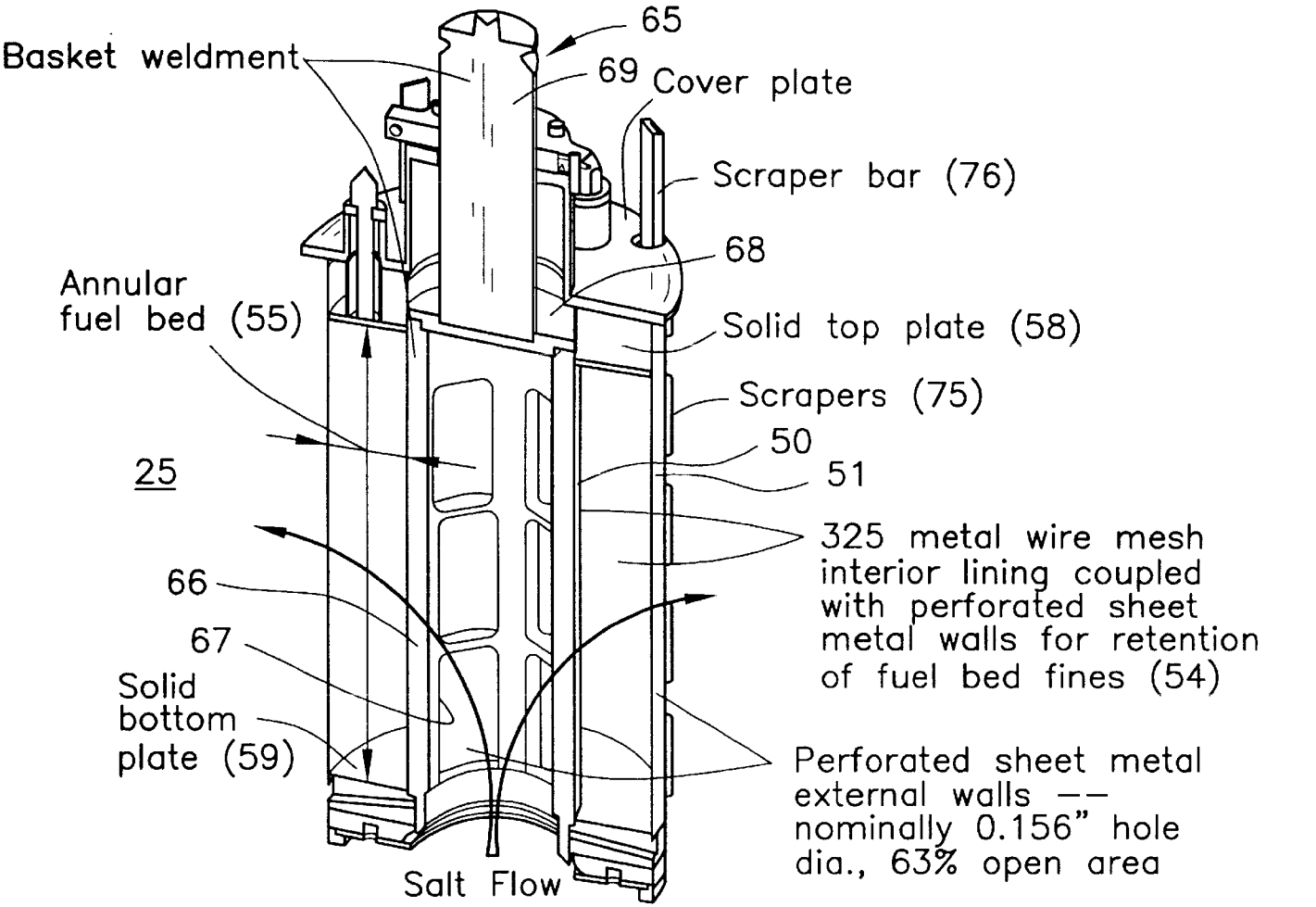
FIG. 2 is a schematic illustration of an universal basket configuration for an oxide reduction operation.
Figure 3:
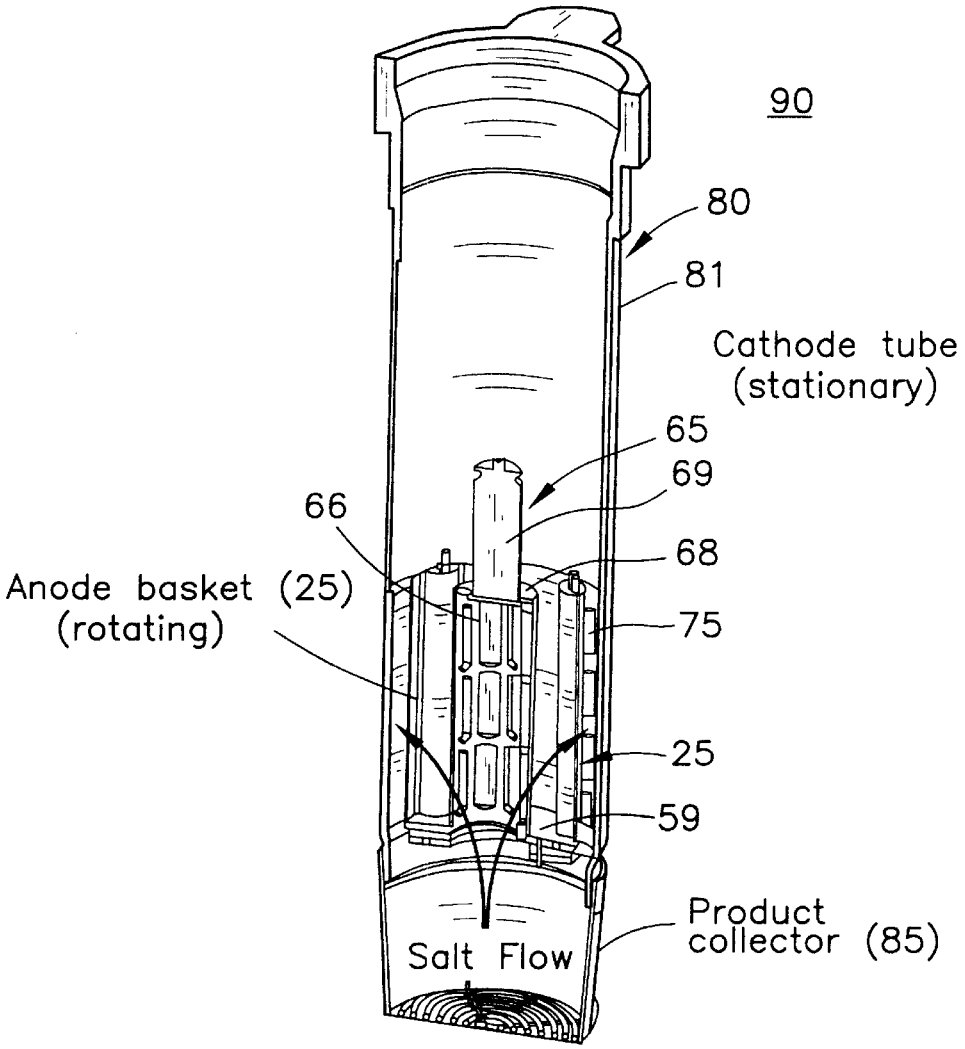
FIG. 3 is a schematic representation of an universal basket configuration for an electrorefining operation as an anode-cathode-module.
Figure 4:
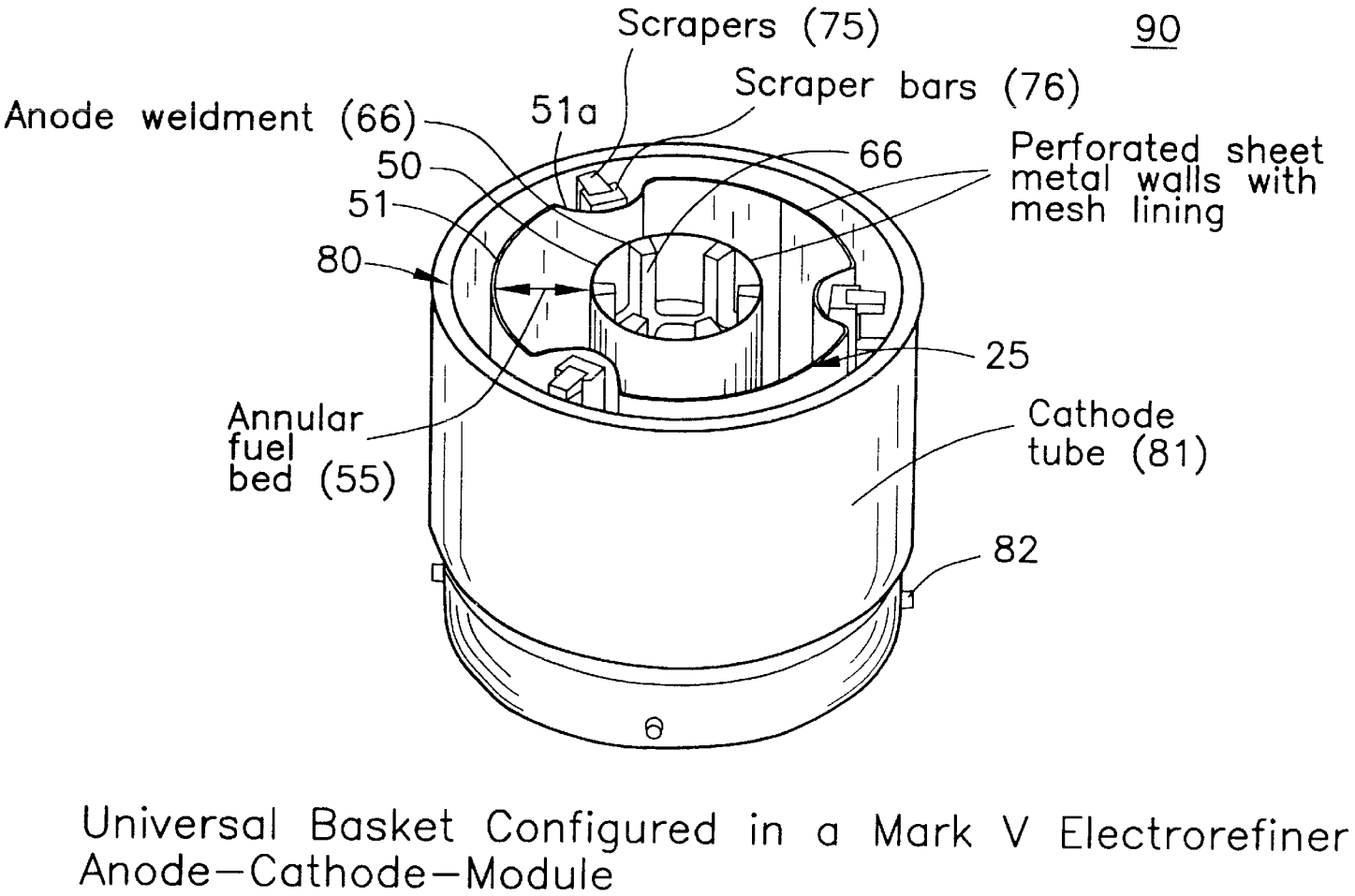
FIG. 4 is an enlarged schematic view of the universal basket illustrated in FIG. 3.

Each of the universal baskets 25, as at best seen in FIGS. 2 through 4, contains a perforated inner cylindrical wall 50 and perforated outer cylindrical wall 51, each of the perforated walls preferably have 0.156 inch hole diameters totaling a 63% open area. The outer perforated cylindrical wall 51 may be provided as shown in FIG. 4 with circumferentially spaced apart inwardly facing lobes 51*a*, for purpose hereinafter set forth. The inner perforated cylindrical metal wall 50 and the outer perforated cylindrical metal wall 51 are each preferably provided with a 325 metal wire mesh screen having a nominal width opening of 0.0017 inches and an open area of about 30%. The concentrically disposed inner and outer cylindrical wall 50 and 51 define a fuel bed annulus 55 therebetween. The fuel bed annulus 55 is enclosed by a removable substantially solid top plate 58 interconnecting the inner and outer cylindrical wall 50 and 51 and a substantially solid bottom plate 59 also interconnecting the inner and outer cylindrical wall, thereby to enclose the fuel bed 55 which is continuous and unsegmented, as defined herein.

A basket transfer device 65 is preferably welded or otherwise connected to the annulus fuel bed 55 by means of a cylindrical frame member 66 which is provided with substantial, large rectangularly shaped opening 67 therein and which has a cap 68 at the top enclosing the cylindrical frame member 66 and upstanding weldment 69 or shaft which maybe remotely grabbed by mechanism in order to move the universal basket 25 from place to place.

A plurality of scrapers 75 are longitudinally spaced along a scraper bar 76 associated with the outer cylindrical wall 51 and may be positioned within the indented lobes 51*a* as shown in FIG. 4. The scrapers 75 circumferentially spaced around outer cylindrical wall 51 are for a purpose herein and after set forth.

When used in an electrofiner, as opposed to oxide reduction, the universal basket 25 forms a rotating anode positioned within but electrically insulated from a cathode in the form of a cylinder 80, as best seen in FIGS. 3 and 4. The cathode 80 is in the form of a cylindrical tube 81 having ribs at the bottom thereof 82 for connection to product collector 85, as seen in FIG. 3. The bottom plate 59 of the universal basket 25 is preferably covered with an electrical insulator so as to prevent shorting between the universal basket 25 anode and the cathode 80 in the electrorefiner. To this end, there is preferably provided a ceramic coating on the outer surfaces of the bottom of the universal basket 25. The ceramic coating may be any insulating ceramic material which does not react with the chemicals in the electrorefining process, that is the molten salt and the products in the basket 25 which are generally the segmented fuel rods and fission products to be processed. Preferably the ceramic is an oxide and most preferably this ceramic insulating material is $ZrO_2$. Other insulating material may be used.

In the electrorefiner 90, material in the universal baskets 25, uranium metal is electrochemically moved from the fuel bed 55 in each universal basket 25 which is rotating with respect to the cathode 80 by means (not shown) while salt flows upwardly through the annulus fuel bed 55 and outwardly toward the cathode 80 and particularly the cathode wall 81. As dendrites of uranium are formed on the inner wall of the cathode tube 81, the scrapers 75 scrape the uranium material accumlating on the inside of the cathode tube 81 removing it from the wall 81 and allowing it to drop into the product collector 85 where it is thereafter collected and processed. As will be seen from the various figures, salt flow enters the universal basket 25 through a cylindrical opening at the bottom and moves upwardly through the openings 67 in the cylindrical frame members 66 through the perforated inner and outer cylindrical metal walls 50 and 51 toward, in the case of the reduction vessel 10, the lithium jacket 30, and in the case of the electrorefiner 90 toward the cathode 80.

As is well known in the art, the processing of spent nuclear fuel includes two basic processes. First, the fuel in the form of uranium dioxide and transuranium elements is reduced by the presence of lithium metal in a saturated lithium chloride salt to uranium metal and lithium oxide. After the reduction is completed in the oxide reduction system 10, the material and the universal baskets 25 are physically transported by mechanism not shown to the electrorefiner 90. In the electrorefiner 90, the anodes which are the baskets 25 rotate, effecting the salt flow upwardly through the fuel baskets 25, with respect to a stationary cathode 80.

When an electrical potential is established between the anode 25 and the cathode 80, uranium metal in the anode is oxidized into the electrolyte which contains lithium chloride and deposits as uranium dendrites on the inner surfaces of the cathode tube 81. The uranium metal dendrites are thereafter scraped from the insides of the cathode tube 81 and fall into a product collector 85 for later processing. This invention is a significant improvement over the prior art because it permits the same basket which holds the chopped fuel in the reduction vessel 10 to be used as a rotating anode in the electrorefiner 90.

Specific design requirements for a pilot-scale oxide reduction process included: 1) Scale-up of the system from a nominal 10-kg heavy metal (uranium)engineering-scale to approximately 100-kg heavy metal pilot plant scale; and 2) Compatibility with an existing Mark V electrorefiner. The basic scaling parameter for the oxide reduction process is a nominal 5 liters of molten lithium chloride at 650° C. per 1 kg of heavy metal to be chemically reduced. The engineering-scale equipment operated with approximately 75 liters of molten lithium chloride at 650° C. and 10 kg of heavy metal as uranium oxide, although amounts of heavy metal upwards to 20 kg could also have been accommodated. The engineering-scale equipment was configured with an open pool of molten salt contained within a heated crucible. A mixing impeller was positioned off center to stir the molten salt. Lithium metal was configured in the pool by either allowing it to float on top of the salt (due to its lower density and limited solubility in the salt) or to suspend it below the salt surface with porous metal, which was also positioned off-center. Thus, salt stirring promoted saturation of the salt with elemental lithium. Fuel baskets of varying configurations were introduced into the molten pool via another off-center port and were held stationary.

In scaling the oxide reduction process from lab to engineering scale, it became evident that the reduction time increased in the engineering-scale equipment versus that at lab scale, apparently due to the larger packed fuel bed sizes at engineering-scale and consequently limited mass transfer rates of reactants and reaction products through the packed bed. We believed that this limitation would be worse for a like configuration at pilot-scale, due to even larger packed fuel bed volumes. We determined that it would be advantageous to configure the fuel basket in the pilot-scale oxide reduction equipment such that the molten salt saturated with elemental lithium would be forced through the fuel bed. Thus, forced flow through a fuel bed is a significant feature of the present invention for a pilot-scale oxide reduction fuel basket.

We determined that the integrated reduction/electrorefining processes would be significantly simplified if the oxide fuel were contained within a basket that was universal to both the reduction and electrorefining processes. This obviates one having to remotely unload fuel from an oxide reduction process and subsequently reload it into an electrorefining fuel basket. Carryover of oxide reduction salt in an universal basket is accommodated in the Mark V electrorefiner salt system. However, the existing Mark V anode basket was incompatible with the need to force flow through the packed fuel bed. The configuration of open channels between baskets on the same radius and the gap between the inner and outer array of baskets in the existing Mark V anode basket did not lend itself well to forcing flow through the fuel bed in the proposed oxide reduction process. Compatibility with the Mark V electrorefiner did however, require that a universal basket maintain its cylindrical configuration.

Thus, we developed a universal basket 25 as an unsegmented, cylindrical, annular packed bed with solid bottom and top plates. A salt circulation system 35 with a helical-bladed impeller 36 tube provides the circulation necessary to force salt though a distribution plenum to a plurality of universal baskets 25. The salt flows through the fuel baskets 25 as a radial plug flow and across the suspended lithium sources 30 which are configured to suspend the lithium metal below the salt surface so that they are in proximity to the universal baskets 25 and consequently within the flow path induced by the salt circulation system. Passing the salt flow across the lithium sources or jackets 30 promotes the saturation of salt with elemental lithium. An unsegmented fuel basket 25 also allows for higher fuel loadings, while working within the dimensional envelope imposed by the existing Mark V electrorefiner equipment. The universal baskets 25 are sized to hold approximately 25 kg of heavy metal as uranium oxide fuel. Thus, the pilot-scale oxide reduction system is configured to accommodate 4 universal baskets 25 and 500 liters of molten lithium chloride at 650° C. FIGS. 1 and 2 illustrate the reduction vessel and universal basket configurations, respectively, for pilot-scale oxide reduction operations.

The following table summarizes the universal basket features in the reduction process versus the prior art engineering-scale equipment.

TABLE 1

Comparison and Contrast of Universal Basket Features in the Pilot-Scale Oxide Reduction Process with that of the Prior-Art Engineering-Scale Equipment.

| Feature | Pilot Scale | Prior-Art Engineering Scale |
|---|---|---|
| Forced flow through a packed fuel bed | A stationary universal basket is configured with a salt circulation system to force flow through a packed fuel bed. | A stationary fuel basket was suspended in a molten salt pool. Any flow through the fuel basket was random as a result of mixing the salt pool. |
| Packed fuel bed configuration | The universal basket is configured as an unsegmented, cylindrical, annular fuel bed with solid bottom and top plates. | Relevant operations were performed with straight-walled or curvilinear-walled rectangular fuel baskets. |
| Fuel loading | 4 universal baskets with an estimated heavy metal fuel loading of 25-kg per basket | Limited by the scale of equipment to 10–20 kg heavy metal |
| Salt stirring | Central impeller configured to force flow through a distribution plenum to a plurality of universal basket as radial plug flow through the packed fuel beds. | Off-center impeller stirs molten salt pool. |
| Lithium source | Lithium metal is suspended below the salt surface by porous metal and is configured to jacket, but not contact, the universal basket and intersect with the salt flow imparted by the salt circulation system | Lithium metal is allowed to float on top of the molten salt pool or is suspended below the salt surface by porous metal. The porous metal is configured off-center within the molten salt pool. |

The Mark V electrorefiner 90 operates to electrochemically transport uranium metal from an anode basket 25 of metallic fuel to a cathode 80 within an Anode-Cathode-Module (ACM) that is suspended in a molten salt electrolyte, see FIGS. 3 and 4. The Mark V electrorefiner 90 is configured to operate with up to 4 ACMs simultaneously. Within an ACM, the anode basket 25 rotates concentric to a stationary cathode 80. Under an electrical potential, uranium dendrites are deposited on the cathode surfaces 81 and simultaneously removed by scrapers 75 mounted on the rotating anode basket 25. When dislodged, the dendrites fall and are collected by a product collector 85. In an effort to minimize the electrochemical cell potential within an ACM, the anode baskets 25 for the Mark V electrorefiner 90 previously were configured with segmented baskets in radial arrays, which were in proximity and concentric to adjacent cathode surfaces. Specifically, the anode basket was arranged with 6 curvilinear, segmented compartments (also referred to as fuel dissolution baskets) in an outer ring, and 3 in an inner ring. Each compartment was suspended from an anode weldment. Each annular ring of compartments was enveloped on both sides by concentric cathode surfaces. The nominal gap size between a compartment wall and a cathode surface was ⅛ inch. This distance was halved by scraper blades which protruded from mountings adjacent to each basket compartment, i.e. the clearance between the cathode surface and the scraper was 1/16 inch. The basket compartments in a given array were segmented to allow a cavity for dislodged dendrites to fall. The basket compartments were formed from perforated metal on three of the four curvilinear sides with 0.16 inch hole diameters and a nominal open area of 30 to 40%. One side of each fuel bed compartment was not perforated because of the respective adjacent scraper mounting. The following contrasts features of the inventive universal basket 25 with the existing Mark V anode baskets.

In contrast to the existing Mark V anode basket, the universal basket 25 is unsegmented between basket compartments within a ring and unsegmented between rings, as shown in the sectional view of FIGS. 2 and 3. Consequently the cathode 80 is modified such that the inner and middle tubes and adjoining bottom support are removed. Thus, electrotransport of material occurs from a continuous packed bed 55 to the remaining outer cathode tube's inner surface 81. Scrapers 75 are also mounted on the universal basket 25 to dislodge dendrites from the cathode surface.

A universal basket 25 within a modified ACM is configured for higher flow through the fuel bed 55. As an unsegmented, cylindrical, annular, packed fuel bed configuration, the universal basket 25 acts as a centrifugal pump when rotated. Flow is drawn up through the bottom center opening and forced through the packed fuel bed 55. In contrast to the previous segmented basket, the universal basket 25 is not configured with an inner cathode tube in order to lessen the impedance of flow through the packed bed.

In contrast to the segmented anode baskets, which are open on the bottom surface and are configured to mount scrapers, the universal basket 25 has a solid bottom plate 59, mounts no scrapers and the underneath side is electrically insulated as with a ceramic such as $ZrO_2$.

The segmented baskets operate without a mesh lining. Thus, the retention of particle sizes within the basket are limited to the 0.16 inch hole diameters in the wall (30 to 40% open area). In contrast, the universal basket 25 may be configured with a 325 metal wire mesh 54 coupled with the perforated sheet metal wall 50, 51 (0.156 inch hole diameter and 63% open area). The 325 mesh 54 has a nominal width opening of 0.0017 inch open area of 30%. Clearly, the inner and out cylindrical walls 50 and 51 may have larger or smaller openings and may have greater or lesser open area than the described 63%. Also, the screen 54 may be larger or smaller mesh than 325 and may have greater or lesser open area than the described 30%.

While there has been disclosed what is considered to be the preferred embodiment of the present invention, it is understood that various changes in the details may be made without departing from the spirit, or sacrificing any of the advantages of the present invention.

The embodiments of the invention in which an exclusive property or privilege is claimed are defined as follows:

1. A basket for use in the reduction of $UO_2$ to uranium metal and in the electrorefining of uranium metal, said basket comprising an inner and outer perforated cylindrical wall defining a continuous annulus therebetween, a screen adjacent to each perforated cylindrical wall, a substantially solid bottom and top plate enclosing the continuous annulus formed by said inner and outer perforated cylindrical walls defining a fuel bed, a plurality of scrapers mounted adjacent to the outer perforated cylindrical wall extending longitudinally thereof, and mechanism enabling said basket to be transported remotely.

2. The basket of claim 1, wherein the bottom of the basket is an electrical insulator.

3. The basket of claim 2, wherein the insulator is a ceramic.

4. The basket of claim 3, wherein the insulator is $ZrO_2$.

5. The basket of claim 1, wherein the inner and outer perforated cylindrical walls have about 63% open area.

6. The basket of claim 5, wherein the screen adjacent to each perforated cylindrical wall has about 30% open area.

7. The basket of claim 1, and further comprising a crucible surrounding said basket, a source of lithium metal substantially surrounding said basket inside said crucible, a source of molten salt containing LiCl substantially saturated with lithium metal in contact with said basket and said source of lithium metal, and impeller mechanism for forcing said molten salt substantially saturated with lithium metal through the inner cylindrical wall in contact with $UO_2$ in the fuel bed to cause $UO_2$ to be reduced to uranium metal.

8. The basket of claim 7, wherein four baskets are positioned inside said crucible with said impeller mechanism being centrally located with respect to the baskets.

9. An anode-cathode module for the electrorefining of uranium, comprising an anode formed by a continuous annular fuel bed defined by inner and outer perforated cylindrical walls having substantially solid top and bottom plates for holding uranium values, a plurality of scrapers circumferentially spaced around said outer perforated cylindrical wall extending longitudinally thereof, a cylindrical cathode spaced from and surrounding said anode defining an annular electrolyte space, said anode and cathode being electrically insulated from each other, and mechanism for causing electrolyte to flow upwardly through the inner perforated cylindrical wall rotating said anode with respect to said cathode and the annular fuel bed with the uranium values therein, the electrolyte flowing into the annular electrolyte space to establish electrotransport of uranium values between the anode and cathode resulting in the precipitation of uranium values on the cylindrical cathode upon establishment of an electrical potential between the anode and cathode.

10. The anode-cathode module of claim 9, wherein said anode bottom plate electrically insulates said anode from said cathode.

11. The anode-cathode module of claim 10, wherein the portion of said anode bottom plate in contact with the electrolyte is an electrically insulating ceramic.

12. The anode-cathode module of claim 11, wherein the ceramic is $ZrO_2$.

13. The anode-cathode module of claim 11, wherein the electrolyte is a molten electrolyte.

14. The anode-cathode module of claim 9, wherein the inner and outer perforated cylindrical walls have about 63% open area.

15. The anode-cathode module of claim 14, and further comprising screens adjacent to each of said perforated walls, each of said screens having about 30% open area.

16. The anode-cathode module of claim 15, wherein each of said screens is about 325 mesh.

17. The anode-cathode module of claim 9, and further comprising a product collector axially aligned with said anode and positioned therebelow to receive uranium metal scraped from said cathode during the electrorefining of uranium.

* * * * *